United States Patent [19]

Hayden

[11] 4,345,227

[45] Aug. 17, 1982

[54] PUSH-ON PUSH-OFF SWITCH

[75] Inventor: Rodney Hayden, Stoney Creek, Canada

[73] Assignee: TRW Inc., Cleveland, Ohio

[21] Appl. No.: 265,946

[22] Filed: May 21, 1981

[30] Foreign Application Priority Data

Jun. 10, 1980 [CA] Canada ..... 353697

[51] Int. Cl.[3] ..... H01H 45/02; H01H 51/06

[52] U.S. Cl. ..... 335/186; 335/164

[58] Field of Search ..... 335/186, 164, 238; 340/644

[56] References Cited

U.S. PATENT DOCUMENTS 3,526,863 9/1970 Vogelsang ..... 335/186

4,095,213 6/1978 Hayden ..... 335/186

*Primary Examiner*—Harold Broome

*Attorney, Agent, or Firm*—James R. O'Connor

[57] ABSTRACT

An electrical switch with a magnetic core for driving a first contact for engaging a second spring mounted contact. A plunger can engage the core to move it into a winding moving the first contact so that current is supplied to the winding for holding the core in inner position when the first and second contacts connect. The plunger carries an arm which can engage the spring mount for the second contact and move it away from the first contact, only when the second contact is in its deflected position by virtue of engagement by the first contact. A housing, an indicator light and connecting terminals are also provided.

8 Claims, 3 Drawing Figures

PUSH-ON PUSH-OFF SWITCH

This invention relates to electrical switches having particular reference to those which can be switched to the on and to the off condition by movement of an actuator in the same direction for each change.

While switches of the type described find use in a wide variety of instances, the specific embodiment of the invention here described is particularly useful in motor vehicles and is capable of controlling quite heavy direct currents such as may be required for on pane window heaters for demisting, defogging, or defrosting purposes, and is provided with a holding coil drawing relatively low current, and may include a pilot lamp or light emitting diode for indicating the condition of the switch.

Switches capable of providing relatively heavy current control and employing holding coils are illustrated, for instance, in my prior U.S. Pat. Nos. 4,003,011 issued Jan. 11, 1977; 4,064,470 issued Dec. 20, 1977; 4,095,213 issued June 13, 1978; and my Canadian Pat. No. 978,577 issued Nov. 25, 1975.

It is an object of the present disclosure to provide a switch apparatus which can be closed or opened by unidirectional movement of an actuating piece, which can carry relatively heavy currents which may be made substantially immune to normal vibration and which may provide an indication of the condition of the switch.

More particularly in accordance with the invention there is provided an electrical switch which comprises a winding, a magnetic core movable into said winding between an open and closed position, a first contact carried by said core, means mounting said first contact to said core for moving said contact towards and into electrical connection with a second contact upon movement of said core between said open and closed position, said core being urged to said open position in the absence of magnetizing field exerted by said winding, means connecting one end of said winding to said first contact, plunger means for urging said core into said winding upon manual movement of said plunger means in a chosen direction, a spring mounting for said second contact permitting resilient movement of said second contact upon connection with and pressing by said first contact when said core is moved into said closed condition, an arm carried by said plunger movable into contact with said second contact mounting means for urging said mounting means in a direction to move said second contact away from said first contact only when said core is in said closed condition and said plunger is manually actuated and moved in the chosen direction to urge said core into said winding. The first contact may include an obturator structure which is bowed towards the second contact upon movement of the core between open and closed positions. The second contact mounting means may comprise a resilient leaf member having a surface engageable by the arm so that movement of the surface against the arm effects the urging of the mounting means. There may be illumination indication means adjacent the switch providing illumination on closure of the contacts. The switch may comprise an insulating base with first, second and third connecting terminals carried by the base. The resilient movement of the spring mounting for the second contact may position the mounting for engagement and urging by the arm.

Specific embodiments of the invention will now be described having reference to the accompanying drawings, in which.

Figure 1:
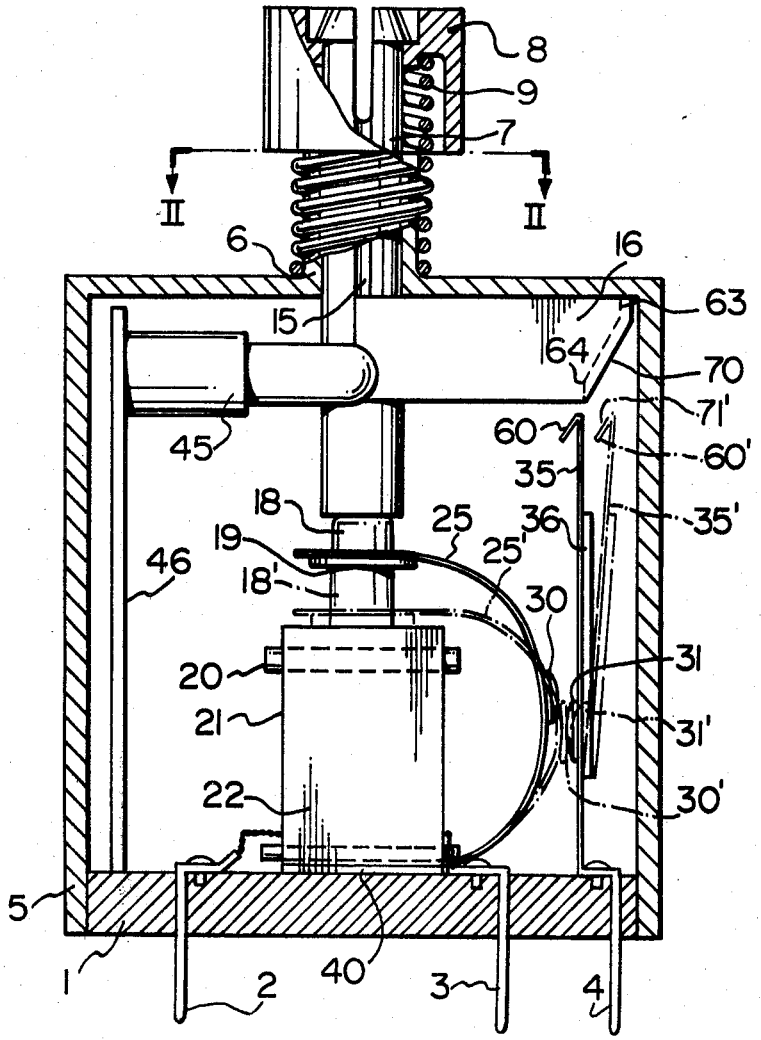
FIG. 1 is a side view partly in section of a novel switch assembly.

The switch assembly comprises an insulating base 1 with terminal pins 2, 3, and 4 and carrying a housing 5. The housing has a neck 6, receiving a hollow actuating stem or plunger 7 movable between an outer and an inner position by means of push knob 8 urged outwardly by spring 9. The stem 7 is grooved at 15 to receive an extension piece 16 mounted transversely on it within the housing and the stem further extends downwardly into the housing to contact the upper end 18 of a relay core 19. The core 19 is received within a bobbin 20, carrying a coil 21 and mounted in a magnetic yoke 22. Integrally fastened to the core 19 is an armature spring 25 of the obturator type which is bowed in a C-shape, is fastened to the lower part of the yoke and carries a contact 30 for engaging with a contact 31 of a load spring member conductor 35. Conductor 35 includes a transversely displaced stiffening web portion 36.

Terminal 2 is connected to one end of the coil 21, whose other end is connected to the lower end of obturator 25, also bonded electrically to terminal 3. Terminal 4 makes low resistance connection with conductor 35.

When in its innermost condition, the core 19 firmly abuts against the lower plate 40 of the yoke 22, closing the magnetic circuit through the core. In this inner condition upper end 18 of the core 19 is in the position shown at 18' and the obturator 25 takes the position 25' with the conductor 35 taking position 35'. An indicator pilot lamp or light emitting diode is provided at 45 so that it can illuminate the stem 7, which suitably is made of clear plastic such as a polycarbonate, so that the illumination is visible at the push button knob 8. The lamp is suitably mounted on a bracket 46 carried by the base 1 and it is connected by wires, not shown, to terminals 2 and 3.

Figure 2:
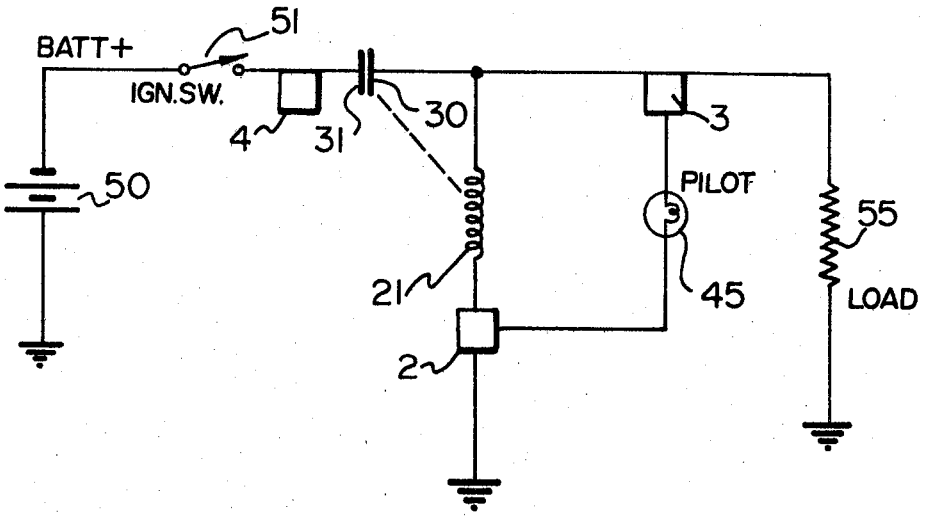
FIG. 2 is a schematic circuit diagram of the switch in a typical circuit in a vehicle.

With reference to FIG. 2, input can be provided from the power source such as battery 50, if desired, through an isolating switch 51 so that the switch can feed a load 55 from terminal 3.

Referring now to both FIGS. 1 and 2, it can be seen that, when knob 8 is pressed downwards, pressure on end 18 of the core from stem 7 will cause the obturator 25 to bow further and contact 30 to move towards and engage contact 31 with an outward and descending wiping action leading to respective resilient displacement of member 35 and low contact resistance. When contacts 30 and 31 make, and, if power is made available at terminal 4, the coil 21 becomes energized producing a magnetizing field. When core 19 approaches the closed condition so that its lower end is adjacent the plate 40, the core will snap to closed condition and will hold in that position when knob 8 is released.

Figure 3:
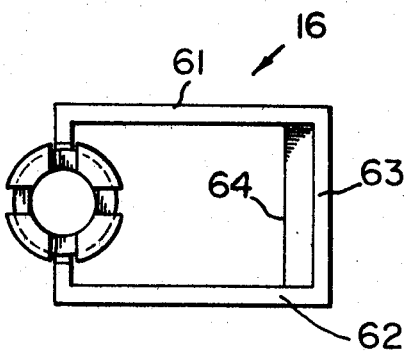
FIG. 3 is a view along line II—II of FIG. 1.

At this point, the arm extension 16 should be observed and its interaction with folded inclined upper end 60 of spring conductor 35. As seen in FIG. 3, the arm 16 consists of two side parts, 61 and 62, carrying a transverse inclined web portion 63. When core 19 is in its outer condition and knob 8 is pressed inwards, the inside lower end 64 of web 63 clears the upper end of conductor 35 without interference until shortly after contact 30 has engaged contact 31. As knob 8 is continued to be pressed inwards, conductor 35 leans outwardly until it contacts the face 64. However, since the conductor is flexible, the knob 8 can be pressed down as far as required to close the relay core into plate 40. When knob 8 is released and extension 16 rises to its uppermost position, the conductor 35 which has been bearing against surface 64 is freed to spring past it and to take up the position at 35'. When in the closed condition in a circuit such as that shown in FIG. 2, heavy current can pass between terminals 4 and 3 to energize the load 55 and illuminate the pilot 45, while the coil 21 carries holding current passing between terminals 3 and 2.

The switch can be released electrically, for instance, by interrupting the circuit to ground through terminal 2, such as by use of a timing circuit placed between terminal 2 and ground. Alternatively the switch 51 may be opened breaking the power supply to terminal 4. In this instance the core releases under the spring action of obturator 25 and any additional conventional spring which may be provided to urge the core away from end plate 40. Contacts 30 and 31 release in consequence.

When the push off action is employed as a third method of deactuation, transverse arm 16 moves down into the housing when knob 8 is pushed. However, in this condition, outer inclined surface 70 of web 63 contacts the inner face 71' of folded end 60' of the conductor 35'. Both surface 70 and the surface of 71' are inclined at essentially the same angle, and conductor 35' is thus swung outwardly so that contacts 31' move away from contacts 30' breaking connection with terminal 3. The magnetic flux through the yoke collapses and core 19 springs outwardly, quickly increasing the distance between contacts 31 and 30 to extinguish any arc and cut down any contact burning. Even if the knob 8 is pressed all the way down so that the core is manually held in the closed position, the conductor 35 is swung well away from its unencumbered position and no further contact between 30 and 31 can be made. The inclined surface 70 insures that no close approach of contacts 30 and 31 can again occur until the upper end of the conductor 35 has cleared the web 70 and core 19 is once again pressed inwards closely to its closed position on the next actuation of the knob 8 to turn the switch on.

The materials for the obturator 25 and the conductor 35 can be formed of beryllium bronze, phosphor bronze or other suitable spring contact material.

It will also be appreciated that, if only low currents are to be handled by the switch, discrete contacts 30 and 31 may not be necessary, contacting between the metal of obturator 25 and conductor 35 being sufficient, particularly in view of the wiping action effected by the obturator structure and mounting.

What is claimed is:

1. An electrical switch which comprises a winding, a magnetic core movable into said winding between an open and closed position, a first contact carried by said core, means mounting said first contact to said core for moving said contact towards and into electrical connection with a second contact upon movement of said core between said open and closed position, said core being urged to said open position in the absence of magnetizing field exerted by said winding, means connecting one end of said winding to said first contact, plunger means for urging said core into said winding upon manual movement of said plunger means in a chosen direction, a spring mounting for said second contact permitting resilient movement of said second contact upon connection with and pressing by said first contact when said core is moved into said closed condition, an arm carried by said plunger movable into contact with said second contact mounting means for urging said mounting means in a direction to move said second contact away from said first contact only when said core is in said closed condition and said plunger is manually actuated and moved in the chosen direction to urge said core into said winding.

2. A switch as defined in claim 1, said first contact including an obturator structure comprising a bowed resilient strip mounted to said core and being further bowed towards said second contact upon movement of said core between said open and closed positions.

3. A switch as defined in claim 1, said second contact mounting means comprising a resilient leaf member including an inclined surface engageable by said arm, movement of said inclined surface against said arm effecting said urging as said plunger moves in the direction to urge said core into said winding.

4. A switch as defined in claim 3 comprising illumination indication means adjacent said switch and electrically connected to said first contact for providing illumination upon closure of said contacts.

5. A switch as defined in claim 4 comprising an insulating base, a first terminal carried by said base connected to said first contact, means mounting said winding on said base, a housing carried by said base, means mounting said plunger in said housing for said urging of said core, said illumination means carried in said housing adjacent said plunger for illumination indication transmission by said plunger, a second terminal carried by said base connected to said second contact, and a third terminal carried by said base connected to the other end of said winding.

6. A switch as defined in claim 5, said means mounting said winding comprising a bobbin, and a magnetic yoke mounting said bobbin allowing closing of magnetic field through said core when said core is moved to closed condition in said winding.

7. A switch as defined in claim 6 comprising power source means being connected to said second terminal and power utilization means connected to said first terminal.

8. A switch as defined in claim 1, said resilient movement of said spring mounting positioning said spring mounting for engagement and said urging by said arm.

* * * * *